United States Patent [19]

Ginn et al.

[11] 3,970,595

[45] July 20, 1976

[54] HEAVY DUTY ALKALINE LIQUID SURFACTANT CONCENTRATE

[75] Inventors: Martin E. Ginn, Park Forrest; Irwin Liebman, Oak Park, both of Ill.

[73] Assignee: Alberto Culver Company, Melrose Park, Ill.

[22] Filed: Nov. 27, 1974

[21] Appl. No.: 527,545

[52] U.S. Cl. ..... 252/545; 252/546; 252/548; 252/DIG. 1; 252/DIG. 14

[51] Int. Cl.[2] ..... C11D 1/83

[58] Field of Search ..... 252/545, 546, 548, DIG. 1, 252/DIG. 14

[56] References Cited

UNITED STATES PATENTS

| | | | |
|---|---|---|---|
| 3,549,544 | 12/1970 | Johnson | 252/545 |
| 3,583,923 | 6/1971 | Cantrell et al. | 252/110 |
| 3,709,838 | 1/1973 | Mausner et al. | 252/545 |
| 3,840,481 | 10/1974 | Miller | 252/546 |

*Primary Examiner*—Thomas J. Herbert, Jr.

[57] ABSTRACT

A heavy duty alkaline liquid surfactant concentrate is prepared by combining a liquid water-soluble nonionic surfactant with a minor proportion of a liquid water-soluble ethanolamine salt of an anionic surfactant containing carboxylic or phosphoric radicals as the anionic groups, and a concentrated aqueous solution of potassium or ammonium hydroxide. The concentration of the hydroxide permits the surfactant concentrate to be highly diluted while limiting the initial amount of water in the surfactant concentrate to not over 10%. The formulation is useful on dilution with water and/or organic solvents as a cleaner, degreaser, wax stripper, and for other heavy duty detergent and cleaning purposes.

11 Claims, No Drawings

HEAVY DUTY ALKALINE LIQUID SURFACTANT CONCENTRATE

BACKGROUND

Highly concentrated surfactant formulations in liquid form have the recognized advantages of reduced product bulk for manufacture and distribution, while permitting the user to readily add water thereto for preparing the proper dilution for use. Such concentrates containing up to 100% active ingredients have been prepared (See, for example, U.S. Pat. Nos. 3,549,544 and 3,709,838). While such prior art formulations have provided satisfactory cleaning power for some applications, they have not been very effective for heavy duty type cleaning uses, unless the user on dilution of the concentrate adds ammonia or other aqueous alkali. Prior to the present invention, pre-formed surfactant liquid concentrates containing concentrated alkali have apparently been limited to preparations in the form of pastes. (See, for example, U.S. Pat. No. 3,583,923).

The addition of concentrated aqueous alkali to concentrated liquid surfactants tends to make the formulations unstable, causing hazing and the formation of precipitated material. Consequently, where the amount of water in the concentrate is to be limited to maximize the content of active ingredients, it has been difficult to incorporate sufficient alkali for effective action of the alkali on dilution of the concentrate. For use as a heavy duty cleaner where the concentrate contains 90% or more active surfactant ingredients, use dilutions as great as 1:300 to 1:400may be desirable. It will therefore be seen that unless the aqueous alkali is present in a concentration permitting a corresponding dilution while remaining effective, there will be a need to add additional alkali on use and the desire to perform a total concentrate of alkali and liquid surfactants is defeated. It is believed that the present invention for the first time provides a satisfactory solution to this problem.

DETAILED DESCRIPTION

In practicing the present invention, there are three key ingredients for preparing the heavy duty alkaline liquid surfactant concentrate: (a) a liquid water-soluble non-ionic surfactant; (b) a liquid water-soluble ethanolamine salt of an anionic surfactant; and (c) a concentrated aqueous alkali solution. The non-ionic surfactant provides the liquid base in which the other ingredients are dissolved to form a stable homogeneous mixture. The combination of all three ingredients in certain relative proportions is essential for achieving the objects of this invention. Concentrated aqueous alkali is not mutually soluble with liquid non-ionic surfactants, and therefore the ethanolamine salt of the anionic surfactant, in the proper proportion, is necessary to improve the mutual solubility of the alkali solution and the non-ionic surfactant.

It appears that any liquid water-soluble non-ionic surfactant can be employed as the solvent base, providing the non-ionic surfactant is not reactive with aqueous alkali. Since non-ionic surfactants are not usually reactive with potassium or ammonium hydroxides, this is not a problem in selecting the non-ionic surfactant. In general, the non-ionic surfactant must be liquid, that is, normally liquid at ordinary temperatures of use (0°–30°C.), and it should be fully water-soluble. With the common ethoxylated non-ionic detergents, the property of water solubility is achieved by incorporating sufficient ethylene oxide to provide the water solubility. Such compounds ordinarily consist of a hydrophobe such as an aliphatic monohydric alcohol or an alkyl phenol, which is reacted with ethylene oxide to form the liquid water-soluble non-ionic surfactant. The aliphatic groups (usually alkyl or alkylene) groups of the alcohols usually contain from 8 to 18 carbon atoms. Fatty alcohols containing from 10 to 14 carbon atoms are particularly desirable. The alkyl phenols may be mono- or di-alkyl phenols in which the alkyl radicals contain of from 5 to 18 carbon atoms. Mono-alkyl phenols containing from 8 to 12 carbon atoms in the alkyl radical are particularly desirable. Usually, at least 6 to 8 moles of ethylene oxide will be reacted with the aliphatic alcohol or alkyl phenol to impart water-solubility, and in some instances up to 18 to 20 moles of ethylene oxide may be incorporated. Particularly suitable non-ionic surfactants for the purpose of the present invention may contain from 8 to 12 moles of ethylene oxide. As indicated above, the overall consideration is to select the non-ionic surfactants to provide the desired properties of being normally liquid and water-soluble.

The anionic surfactant in the form of its ethanolamine salt should also be selected so that it is normally liquid at temperatures of storage and use (viz, 0°–30°C.) and water-soluble. The anionic surfactant in free acid form need not be water-soluble, providing that on reaction with an ethanolamine to form the ethanolamine salt it becomes water-soluble. As used herein, the term "ethanolamine" refers to and includes the three ethanolamines, namely, monoethanolamine, diethanolamine, and triethanolamine. Mixed ethanolamines may also be used to form the ethanolamine salt of the anionic surfactant. The anionic detergent should be selected for compatibility with aqueous alkali. Usually, this will be achieved by prereacting the acid groups of the anionic surfactant with the ethanolamine to covert the acid radicals to their ethanolamine salt form. Such liquid water-soluble ethanolamine salts of anionic surfactants are, in general, mutually soluble in all proportions with liquid water-soluble non-ionic surfactants. For the purpose of the present invention, however, only a minor proportion of the anionic surfactant ethanolamine salt is incorporated with the non-ionic surfactant. When the ethanolamine salt of the anionic surfactant provides the properties specified, namely, being water-soluble, normally liquid, mutually soluble with the liquid non-ionic surfactant, and compatible with aqueous alkali, the specific chemical make-up of the anionic surfactant may vary. For example, different acid radicals can provide the anionic properties. It has been found that the desired properties can be obtained with particular advantage by employing anionic surfactants having carboxylic (or carboxylate in salt form) and phosphoric (or phosphate in salt form) radicals as the anionic groups thereof. For example, excellent results have been obtained by employing as the anionic surfactant an alkyl phenol polyethyleneoxy alkylene carboxylic acid. In general, the formula for such anionic surfactants is: $RO(CH_2CH_2O)_xAc$ wherein "R" is an alkyl phenol group, Ac is an alkylene monocarboxylic acid group, and $x$ represents the number of moles of ethylene oxide in the molecule. Such compounds are alkali compatible, and in the form of their ethanolamine salts are water-soluble and mutually soluble with liquid non-ionic surfactants. The R may be mono- or di-alkyl phenols, although the mono-alkyl phenols are preferred. The alkyl groups bonded to the phenol may contain a total of from 5 to 18 carbons, such as, particularly, mono-alkyl phenols in which the alkyl group contains from 8 to 12 carbons. The alkylene monocarboxylic acid groups is a lower aliphatic monocarboxylic acid, such as $C_2$ to $C_4$ monocarboxylic acids. In particular, the Ac group may be acetate or propionate. The number of moles of ethylene oxide in the molecule may range from 4 to 20 moles, such as particularly 4 to 10 moles. As indicated, however, the ethylene oxide content need not be sufficient alone to import water-solubility to the free acid form, providing the ethanolamine salt thereof is water-soluble. Other suitable anionic surfactants include those containing phosphoric acid radicals as the anionic groups. Such compounds include the higher aliphatic (alkyl or alkylene) acid phosphates. Such compounds can be prepared by reacting fatty alcohols with phosphorus pentoxide, and other known processes, and are available commercially. For example, mono- or di-aliphatic hydrogen phosphates are desirable, where the aliphatic groups contain from 8 to 18 carbons. For example, di-alkyl monohydrogen phosphates give good results, and the alkyl groups may contain from 8 to 14 carbons.

As indicated above, the third key ingredient is the concentrated aqueous alkali. For use in surfactant formulations to be employed as heavy duty cleaners or degreasers, the alkali is preferably potassium or ammonium hydroxide. To provide the desired high concentration of active ingredients in the surfactant concentrate, the total amount of water in the concentrate should be limited, and therefore the potassium or ammonium hydroxide solutions should be as concentrated as practical. For the purpose of the present invention, it is desirable to limit the total water content of the surfactant concentrate to not over 10% by weight. The concentration of the potassium or ammonium hydroxide can be expressed in relation to the total water of the surfactant and on the basis of hydroxyl ion concentration. In general, the aqueous alkali solution should have a hydroxyl concentration of at least 8% by weight based on the alkali solution (total water and alkali). In preferred embodiments, the aqueous alkali solution will provide a hydroxyl ion concentration of at least 10% by weight or above based on the alkali solution. It is advantageous to incorporate the alkali solution with the potassium or ammonium hydroxide near 100% saturation. For practical purposes, however, potassium hydroxide solutions of about 30 to 45% by weight KOH and ammonium hydroxide solutions of about 20 to 30% by weight $NH_4OH$ can be used.

The relative proportions of the three ingredients discribed above are important. It is desirable to combine the ingredients with certain ranges of proportions. In general, from 10 to 50 parts by weight of the anionic surfactant ethanolamine salt is incorporated for each 100 parts of the non-ionic surfactant. In certain preferred formulations, from 15 to 35 parts by weight of the anionic surfactant ethanolamine salt is present per each 100 parts of the non-ionic surfactant. The amount of aqueous alkali solution is subject to the limitation mentioned previously, that is, the surfactant concentrates should not contain over 10% water by weight. Within that limitation and in general, from 2 to 10 parts by weight of the aqueous alkali solution can be present for each 100 total parts of the non-ionic and anionic surfactants, that is, the amount of aqueous alkali is based on the total of the mixture of the liquid surfactants (non-ionic and anionic ethanolamine salt). In certain preferred embodiments, from 2 to 8 parts by weight of the aqueous alkali solution are present per 100 parts of non-ionic and anionic surfactants.

Simple mixing procedures can be employed for preparing the concentrate, mild heating being employed if necessary to promote the mutual solution of the ingredients. The anionic detergent is preferably converted to its ethanolamine salt and then mixed with the liquid non-ionic surfactant. After a homogeneous mutual solution is formed with the anionic detergent in its ethanolamine salt form, the aqueous alkali solution is added gradually and blended with the liquid surfactant mixture to form the concentrate base. As will be appreciated by those skilled in the art, other ingredients may then be incorporated in this base, such as organic solvents, if it is desired to improve the oil removal or degreasing properties of the formulation. The base formula and its possible modifications, as well as other features of the invention, will be further illustrated by the following examples.

EXAMPLE I

Base formulation concentrates can be prepared according to the following general formulation:

| Ingredients | Parts by Weight |
|---|---|
| Non-ionic surfactant | 60 – 70 |
| Anionic surfactant (as ethanolamine salt) | 10 – 20 |
| Concentrated aqueous KOH or $NH_4OH$ | 5 – 7 |

For example, in accordance with the above general formula, an alkyl phenol polyethyleneoxy alkylene monocarboxylic acid is reacted with sufficient triethanolamine to convert the carboxy groups to ethanolamine salt form. In a particular embodiment, this was accomplished by reacting 9.26 parts by weight of triethanolamine with 4.61 parts of the anionic surfactant "Triton DF-20" sold under this identification by Rohm & Haas Company, Philadelphia, Pa. The resulting triethanolamine salt of the carboxylic groups (carboxylate) is water-soluble and alkali compatible. To promote the reaction and to prepare the anionic salt for combination with the non-ionic detergent, the reactants may be warmed (viz, to 100° – 120°F.). Into this warmed ethanolamine reaction product, there is slowly mixed 59.88 parts by weight of a liquid water-soluble non-ionic surfactant, such as "Biosoft EA-8," a non-ionic surfactant sold under this identification by Stepan Chemical Company, Northfield, Illinois. Biosoft EA-8 is the reaction product of long chain fatty alcohols ($C_{12}$ – $C_{14}$) with approximately 8 moles of ethylene oxide. Heating of the resulting mixture is discontinued, and the concentrated aqueous alkali is added, namely, 4.83 parts by weight of 45% potassium hydroxide or 26° Baume aqueous ammonia (approximately 29% $NH_4OH$). The mixing is continued until a uniform homogeneous mixture is obtained. The resulting product can be used as a cleaner by dilution with from 1 part of concentrate per 250 to 350 parts of water. For example, from ⅓ to ⅔ ounces of the concentrate can be used per gallon of water.

EXAMPLE II

Following the formula and procedure of Example I, other anionic surfactants can be converted to their ethanolamine salts, and employed in the concentrates. For example, dilauryl monohydrogen phosphate can be reacted with sufficient monoethanolamine to convert the phosphoric acid (or phosphate) groups to the ethanolamine salt form. The resulting ethanolamine salt can then be used in the proportions indicated in Example I. If desired, an additional mutual solvent may be included such as "Dowanol DPM," dipropylene glycol methyl ether, sold by Dow Chemical Co., Midland, Mich. A foam booster may also be included such as an alkanolamide like the condensate of diethanolamine with coconut oil fatty acids.

A more specific formulation for such a concentrate, which may be used as a cleaner and/or degreaser, is as follows:

| Ingredients | Parts by Weight |
|---|---|
| Dilauryl Monohydrogen Phosphate | 2.375 |
| Monoethanolamine | 4.375 |
| Coconut Oil A anolamide (Diethanolamine Condensate) | 2.375 |
| Polyethyleneoxy Lauryl Alcohol | 30.750 |
| 45% Potassium Hydroxide | 2.50 |
| Dowanol DPM | 54.750 |

From the description in Example I, it will be understood that the ethanolamine should be pre-reacted with the dilauryl monohydrogen phosphate before addition of the potassium hydroxide. In one convenient procedure, after the formation of the ethanolamine salt, as described in Example I, the rest of the ingredients are added while mildly warming the mixture, except for the aqueous potassium hydroxide. The completed liquid mixture is allowed to cool to room temperature (20° to 25°C.), and the 45% potassium hydroxide is slowly added until a uniform mixture is obtained, thereby producing the concentrate in accordance with the present invention.

As an alternative, in the above formulation 26° Baume aqueous ammonia is added instead of the potassium hydroxide. The procedure is otherwise the same.

EXAMPLE III

Instead of ethoxylated higher fatty alcohols, as illustrated by Examples I and II, ethoxylated alkyl phenols may be used as the non-ionic detergent. For example, following the procedures and using the proportions of Examples I or II, alkyl phenol ethoxylates, such as "Triton X-100", "Surfonic N-95", or "Triton N 101" can be employed. Triton X-100 is a paraisooctyl phenol polyethyleneoxy ethanol (9.5 moles ethylene oxide, av. mol. wt. 628) supplied by Rohm & Haas Co., Philadelphia, Pa. Triton N 101 is supplied by the same company and is nonyl phenol polyethyleneoxy ethanol (9.5 moles ethylene oxide, av. mol. wt. 642). Surfonic N-95 is paranonyl phenol polyethyleneoxy ethanol (9.5 moles ethylene oxide, av. mol. wt. 632).

EXAMPLE IV

The base formulation of Example I can be further modified for various specific applications. When the surfactant concentrate is to be used as a degreaser, other ingredients can be incorporated, such as coconut fatty acid alkanolamides, ethylene glycol ethyl ether, triethanolamine, EDTA acid (ethylene diamine tetraacetic acid), ethylene glycol monobutyl ether, and additional water up to a total of 10% water for the complete formulation.

For use as a laundry detergent, the base formulation can incorporate ingredients such as coconut fatty acid alkanolamides, ethylene glycol ethyl ether, triethanolamine, EDTA acid, brighteners, soil suspending agents, and dyes.

For use as an ammoniated wax stripper, the base formulation should be prepared with the 26° Baume aqueous ammonia, as described in Example I. To this base formulation, other ingredients can be added, such as monoethanolamine, triethanolamine, EDTA acid, and ethylene glycol monobutyl ether.

EXAMPLE V

The following formulation and manufacturing procedure can be used to prepare a super concentrate cleaner in accordance with the present invention.

| Formulation: % by Weight | Material |
|---|---|
| Part A | |
| 9.500 | Triethanolamine |
| 4.730 | Triton DF-20 |
| 9.450 | Dowanol EE |
| 4.730 | Coconut Oil Alkanolamide (Diethanolamine Condensate) |
| 61.440 | Biosoft EA-8 or EA-10 |
| 4.730 | 45% Potassium Hydroxide |
| Part B | |
| 2.840 | Triethanolamine |
| 0.840 | EDTA Acid |
| 1.240 | Water (Deionized) |
| Part C | |
| 0.500 | Perfume |
| 100.000 | |

MANUFACTURING PROCEDURE

1. Into a stainless steel kettle equipped with an agitator, place all ingredients in Part A, except Biosoft and KOH. Heating is not needed if plant is at normal room temperature (70°–75°F.).
2. Mix until a clear solution with no separation appears.
3. Add all Biosoft with agitation until clear solution develops.
4. Add potassium hydroxide very slowly, maintaining clear or nearly clear solution in the tank.
5. In a separate jacketed vessel add all of the ingredients for Part B, agitate and heat (not over 180°F.) until a clear solution develops.
6. Add clear solution slowly from Part B to main vessel (Part A) with agitation. Mix until clear (only a few minutes). This component may be made in advance to simplify manufacture.
7. Add perfume to main vessel with agitation until solution is uniformly mixed.

EXAMPLE VI

A super concentrate degreaser can be prepared according to the following formulation and manufacturing procedures.

| Formulation: % by Weight | Material |
|---|---|
| Part A | |
| 4.7260 | Triethanolamine |
| 2.3610 | Triton DF-20 |
| 4.7260 | Dowanol EE |
| 2.3610 | Coconut Oil Alkanolamide (Diethanolamine Condensate) |
| 29.7250 | Biosoft EA-8 |
| 3.3580 | 45% Potassium Hydroxide |
| Part B | |
| 1.4430 | Triethanolamine |
| 0.4240 | EDTA Acid |
| 0.6250 | Water (Deionized) |
| Part C | |
| 0.5000 | Perfume |
| 0.0006 | Dye |
| 19.9000 | Dowanol PIB-T |
| 29.8500 | Dowanol PM |
| 100.0000 | |

MANUFACTURING PROCEDURE

1. Into a stainless steel kettle equipped with an agitator, place all ingredients in Part A, except Biosoft and KOH. Heat until mix is at 120°F.
2. Mix until a clear solution with no separation appears.
3. Add all of Biosoft EA-8 with agitation until uniform mixture develops. (Will be slightly cloudy.)
4. Add potassium hydroxide slowly, maintaining clear or nearly clear solution in the vessel.

5. In a separate vessel (jacketed), add all ingredients for Part B, agitate and heat (not over 180°F.) until a clear solution develops.
6. Add this clear solution slowly from Part B to main vessel with agitation. Mix until clear (only a few minutes).
7. To main vessel add Part C ingredients, first adding the perfume and dye (very slowly) with considerable agitation to disperse dye.
8. Mix until dye is dispersed into solution.
9. Then add Dowanol PIB-T very slowly to avoid any cloudiness in the solution. Continue agitation.
10. Add the Dowanol PM very slowly to avoid any cloudiness in the solution.
11. When all the PIB-T and PM have been added, agitate for sufficient time to assure stable solution with no possibility of base separation.

In the foregoing examples, certain ingredients are referred to by trade designation. Such products are more fully identified below, having reference to the following Table of Ingredient Names, and the appended list of Names and Addresses of Ingredient Suppliers.

TABLE OF INGREDIENT NAMES

| "Shorthand" or Trade Name | Chemical Description |
|---|---|
| EDTA Acid Dow | Ethylenediamine Tetraacetic Acid |
| Triton DF-20 Rohm & Haas | Alkylphenol Polyethyleneoxy Alkyl ($C_2 - C_3$) Carboxylic Acid |
| NPPA | Nonylphenol Polyethyleneoxy Acetic Acid |
| Dowanol EE Dow | Ethylene Glycol Ethyl Ether |
| Cellosolve Union Carbide | Ethylene Glycol Ethyl Ether |
| Biosoft EA-8 Stepan | Mixture Polyethyleneoxy Long Chain Fatty Alcohols-Ethyleneoxide Units 8–9 |
| Antara LP-700 | Mixture of Dihydrogen and Monohydrogen Alkylaromatic Organophosphate Acid Esters |
| GAFAC — RA 600 GAF | Mixture of Dihydrogen and Monohydrogen Aliphatic Organophosphate Acid Esters of Long Chain Fatty alcohols ($C_{10} - C_{12}$) |
| Monafax 831 Mona Industries | Mixture of Dihydrogen and Monohydrogen Aliphatic Organophosphate Acid Ester of Long Chain Fatty Alcohols ($C_{10} - C_{12}$) |
| Emphos PF 440 Witco Chemicals | Mixture of Dihydrogen and Monohydrogen Aliphatic Organophosphate Acid Ester of Long Chain Fatty Alcohols ($C_{10} - C_{12}$) |
| Dowanol PM Dow | Propylene Glycol Methyl Ether |
| Dowanol DPM Dow | Dipropylene Glycol Methyl Ether |
| Solvent J Jefferson Chemical | Mixture of Propoxylated and Ethoxylated Short Chain Glycol Ethers |
| Noedol 23-6.5 Shell Chemical | Polyethyleneoxy Long Chain Fatty Alcohols Ethyleneoxide Units — Near 7, Hydrophobe $C_{12} - C_{13}$ |
| Dowanol PIB-T Dow | Propylene Glycol Isobutyl Ether |
| Surfonic N-95 Jefferson | Nonylphenol Mixture of Polyethyleneoxy Long Chain Fatty Alcohols Ethyleneoxide Units — Near 9 |
| Biosoft EA-10 | Mixture of Polyethyleneoxy Long Chain Fatty Alcohols Ethyleneoxide Units — 11, Hydrophobe ($C_{12} - C_{14}$) |

NAMES AND ADDRESSES OF INGREDIENT SUPPLIERS

Jefferson Chemicals Co., Inc.
3336 Richmond
Houston, Texas 77052

Dow Chemical Co., Inc.
Midland, Michigan 48640

-continued

NAMES AND ADDRESSES OF INGREDIENT SUPPLIERS

| |
|---|
| Rohm & Haas Co., Inc.<br>Philadelphia, Pennsylvania 19105 |
| Union Carbide Corp.<br>270 Park Avenue<br>New York, New York 10017 |
| GAF Corporation<br>140 W. 51st Street<br>New York, New York 10020 |
| Mona Industries<br>Paterson, New Jersey 07524 |
| Witco Chemical Corporation<br>277 Park Avenue<br>New Yrok, New York 10017 |
| Shell Chemical Company<br>Houston, Texas 77002 |
| Stepan Chemical Company<br>Northfield, Illinois 60093 |

We claim:

1. A heavy duty alkaline liquid surfactant concentrate, comprising a stable homogeneous mixture containing a total of not over 10% water by weight and consisting essentially of the following ingredients as an unreacted mixture thereof in their stated relative proportions:

a. a liquid water-soluble non-ionic surfactant being the reaction product of ethylene oxide with a hydrophobe selected from the group consisting of the aliphatic monohydric alcohols and the alkyl phenols;

b. a liquid water-soluble ethanolamine salt of an anionic surfactant selected from the group consisting of the alkyl phenol polyethylenoxy alkylene carboxylic acids and the aliphatic hydrogen phosphates, from 10 to 50 parts by weight of said anionic surfactant ethanolamine salt being present per each 100 parts said non-ionic surfactant; and c. from 2 to 10 parts by weight of aqueous alkali solution per each 100 total parts of said non-ionic and anionic surfactants, said aqueous alkali solution being selected from the group consisting of aqueous solutions of potassium hydroxide and ammonium hydroxide having hydroxyl concentrations of at least 8% by weight based on the alkali solution.

2. The surfactant concentrate of claim 1 in which said anionic surfactant has carboxylic radicals as the anionic groups thereof and the said ethanolamine salt thereof is present in the proportion of 15 to 35 parts by weight per each 100 parts of said non-ionic surfactant.

3. The surfactant concentrate of claim 1 in which said anionic surfactant has phosphoric radicals as the anionic groups thereof and the said ethanolamine salt thereof is present in the proportion of 15 to 35 parts by weight per each 100 parts of said non-ionic surfactant.

4. The surfactant concentrate of claim 1 in which said aqueous alkali solution has a hydroxyl concentration of at least 10% by weight based on the alkali solution.

5. The surfactant concentrate of claim 4 in which said alkali solution is a potassium hydroxide solution.

6. The surfactant concentrate of claim 4 in which said alkali solution is an ammonium hydroxide solution.

7. A heavy duty alkaline liquid surfactant concentrate, comprising a stable homogeneous mixture containing a total of not over 10% water by weight and consisting essentially of the following ingredients as an unreacted mixture thereof in their stated relative proportions:

a. a liquid water-soluble non-ionic surfactant being the reaction product of ethylene oxide with a hydrophobe selected from the group consisting of the aliphatic monohydric alcohols and the alkyl phenols;

b. a liquid water-soluble ethanolamine salt of an anionic surfactant having carboxylic radicals as the anionic groups thereof, said anionic surfactant being an alkyl phenol polyethylenoxy alkylene carboxylic acid, from 15 to 35 parts by weight of said anionic surfactant ethanolamine salt being present per each 100 parts of said non-ionic surfactant; and c. from 2 to 10 parts by weight of aqueous alkali solution per each 100 total parts of said non-ionic and anionic surfactants, said aqueous alkali solution being selected from the group consisting of aqueous solutions of potassium hydroxide and ammonium hydroxide having hydroxyl concentrations of at least 10% by weight based on the alkali solution.

8. The surfactant concentrate of claim 7 in which said alkali solution is a potassium hydroxide solution.

9. The surfactant concentrate of claim 7 in which said alkali solution is an ammonium hydroxide solution.

10. The surfactant concentrate of claim 7 in which said alkali solution is aqueous potassium hydroxide of about 30 to 45% by weight KOH.

11. The surfactant concentrate of claim 7 in which said alkali solution is aqueous ammonium hydroxide of about 20 to 30% by weight $NH_4OH$.

* * * * *